US007721581B2

(12) United States Patent
Sundermann et al.

(10) Patent No.: US 7,721,581 B2
(45) Date of Patent: May 25, 2010

(54) SLIDE BLOCK FOR ARTICULATED SPINDLES

(76) Inventors: Christoph Sundermann, Carl-Kraemer-Weg 5, 57271, Hilchenbach (DE); Bob Scoular, 17960 Englewood Dr., Cleveland, OH (US) 44130-3438

( * ) Notice: Subject to any disclaimer, the term of this patent is extended or adjusted under 35 U.S.C. 154(b) by 1137 days.

(21) Appl. No.: 10/544,975

(22) PCT Filed: Feb. 11, 2004

(86) PCT No.: PCT/DE2004/000281

§ 371 (c)(1),
(2), (4) Date: Sep. 19, 2005

(87) PCT Pub. No.: WO2004/072501

PCT Pub. Date: Aug. 26, 2004

(65) Prior Publication Data

US 2006/0141251 A1 Jun. 29, 2006

(30) Foreign Application Priority Data

Feb. 13, 2003 (DE) ..... 103 06 542

(51) Int. Cl.
*B21B 31/07* (2006.01)
*B21B 31/00* (2006.01)

(52) U.S. Cl. ..... 72/249; 72/237

(58) Field of Classification Search ..... 72/237–239, 72/249

See application file for complete search history.

(56) References Cited

U.S. PATENT DOCUMENTS

| | | | | |
|---|---|---|---|---|
| 2,251,126 | A | 7/1941 | Gatke | |
| 2,460,648 | A | 2/1949 | Millar | |
| 2,526,072 | A | 10/1950 | Fraser | |
| 3,713,791 | A | 1/1973 | Oakes | |
| 4,116,028 | A * | 9/1978 | Okamoto et al. | 72/237 |
| 5,422,150 | A | 6/1995 | Scoular et al. | |
| 2002/0134641 | A1 * | 9/2002 | Klopfer et al. | 384/612 |

FOREIGN PATENT DOCUMENTS

| | | |
|---|---|---|
| FR | 2096087 | 2/1972 |
| SU | 553019 | 4/1977 |

* cited by examiner

*Primary Examiner*—Edward Tolan
*Assistant Examiner*—Teresa M Bonk
(74) *Attorney, Agent, or Firm*—Duane Morris LLP

(57) ABSTRACT

The present invention pertains to a slide block for articulated spindles on drives of rolling mills, whereby the articulated spindle (1) has a flat peg (2), whose tongue (3) meshes with a cylindrical opening of the spindle head (4), which opening lies at right angles to the axis of rotation, between which [spindle head] and the flat peg (2) is arranged the slide block (5). The slide block (5) is embodied in a composite construction, with a metallic inner body (6) and an outer layer (7) made of polymer fiber material surrounding this [inner body].

4 Claims, 1 Drawing Sheet

SLIDE BLOCK FOR ARTICULATED SPINDLES

Figure 1:
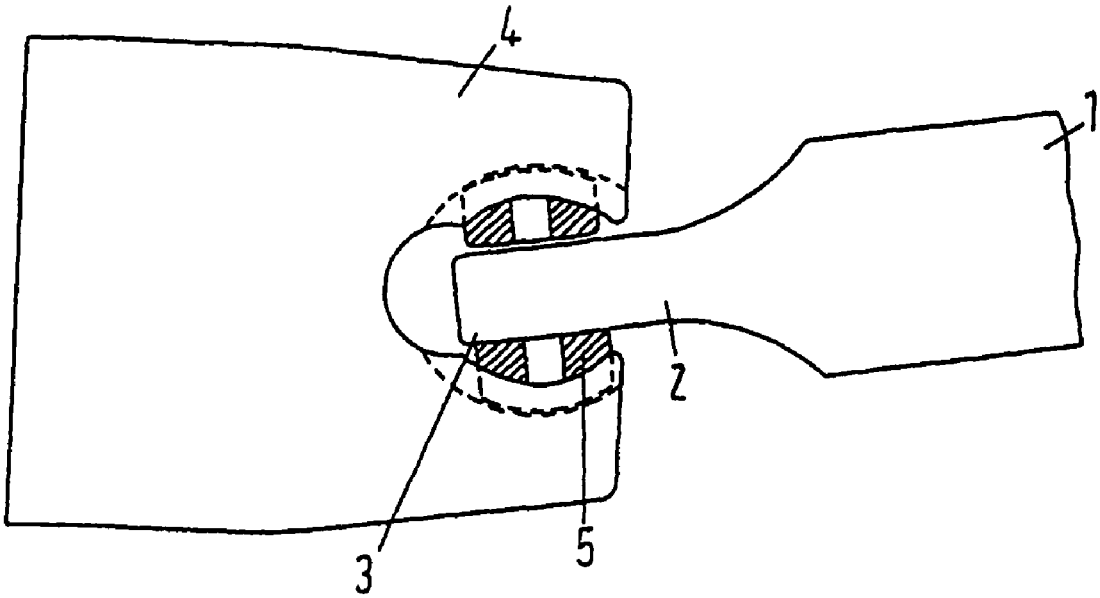

The present invention pertains to a slide block for articulated spindles on drives of rolling mills, whereby the articulated spindle has a flat peg, whose tongue meshes with a cylindrical opening of a spindle head, which [opening] lies at right angles to the axis of rotation, between which [spindle head] and the flat peg is arranged the slide block.

Slide elements or slide blocks, often also called articulated blocks, are known in various embodiments.

Thus, slide elements, namely bearing bushes and bearing shells, consisting of a carrier material made of steel with a cast-on bearing alloy, have been described in WO 99/36210 A1. This [bearing alloy] is lead-free and is based on a copper-zinc or copper-aluminum alloy.

Bearing alloys that contain copper have become known from EP 1 133 588 B1.

Furthermore, a slide bearing has become known from U.S. Pat. No. 5,422,150 A, whereby the coating in this case consists of a polymer compound.

DE 26 56 257 A1 describes articulated blocks for articulated spindles and articulated joint coupling heads of rolling mill drives, which are composed of a plurality of partial segments, whereby these [partial segments] may be made of different materials, such as steel, nonferrous metal or plastic.

Finally, DE 36 23 721 A1, which discloses articulated spindles with lubricated articulated rings, may also be mentioned.

Such copper-containing alloys are characterized by very good sliding and lubricating properties, but have the drawback that copper is released during abrasion. However, for certain rolling processes, especially special rolling products, it is not permissible for the abraded copper particles to reach the rolling process.

In contrast to such bearing bushes or bearing shells that contain rotating parts, in slide blocks torques are transferred, i.e., a completely different type of load.

Attempts at using slide blocks made of plastic for transferring torques have failed up to now, because these materials do not have sufficient contact pressure or high-temperature strength.

Therefore, the basic object of the present invention is to provide a slide block that permits both a high contact pressure and has a sufficient high-temperature strength, without copper or copper alloys being released during abrasion.

This object is accomplished according to the present invention in a slide block for articulated spindles on drives of rolling mills, wherein the articulated spindle has a flat peg, whose tongue meshes with a cylindrical opening of the spindle head, which opening lies at right angles to the axis of rotation, between which [spindle head] and the flat peg is arranged the slide block, in that the slide block is designed as a composite construction with a metallic inner body and an outer layer of polymer fiber material surrounding this [inner body].

It was surprisingly shown that such a polymer fiber material, especially a carbon fiber material, is very suitable for accommodating the high contact pressures and high-temperature strengths that occur in the transfer of torques in rolling mill drives.

The slide block according to the present invention can be used both on the motor side and the roller side.

It is especially advantageous that no additional lubrication, e.g., by means of grease, oil or oil mist, is required. Because of the material properties of this composite slide block, it is possible to omit a cooling; it [cooling] can at least be considerably reduced compared to conventional bearings.

The slide block may have an inner body made of steel and according to another embodiment, splitting the slide block into a plurality of segments is also possible, which are then, of course, also embodied in the composite construction.

As the carbon fiber material, e.g., Hycomp® may be used.

Figure 2:
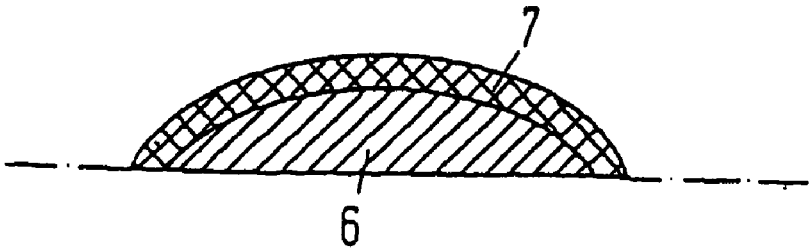

The present invention shall be explained below in an exemplary embodiment, wherein the bearing structure and the embodiment of the slide block are schematically shown in FIGS. 1 and 2.

The articulated spindle 1 has a flat peg 2, whose tongue 3 meshes with a cylindrical opening of the spindle head 4, which [opening] lies at right angles to the axis of rotation.

The slide block 5 is arranged between the flat peg 2 and the surrounding spindle head 4. In the exemplary embodiment shown in FIG. 1, this [slide block] consists of two half-ring-shaped slide block segments, which are connected to one another by means of slide bolts 8.

The schematic view of the cut slide block in FIG. 2 reveals the composite construction of the slide block.

It is evident here that the slide block comprises of a metallic inner body 6 consisting, e.g., of steel, and a carbon fiber outer layer 7.

The invention claimed is:

1. Slide block for articulated spindles on drives of rolling mills, whereby the said articulated spindle (1) has a flat peg (2), whose tongue (3) meshes with a cylindrical opening of a spindle head (4), which opening lies at right angles to the axis of rotation, between which spindle head and said flat peg (2) is arranged said slide block (5), characterized in that said slide block (5) is embodied in a composite construction configured to accommodate high contact pressure during transfer of torque in said rolling mill drives, said composite construction comprising a metallic inner body (6) and an outer layer (7) made of polymer fiber material surrounding said inner body.

2. Slide block in accordance with claim 1, characterized in that said inner body (6) consists of steel.

3. Slide block in accordance with claim 1, characterized in that said outer layer consists of carbon fiber material.

4. Slide block in accordance with any one of the above claims, characterized in that said slide block (5) consists of a plurality of partial segments, which are each embodied in said composite construction.

* * * * *